United States Patent [19]

Köppl et al.

[11] 4,242,549

[45] Dec. 30, 1980

[54] ELECTRICAL GAS-BLAST CIRCUIT BREAKER AND METHOD OF MANUFACTURE

[75] Inventors: Georg Köppl, Birr; Helmut Nowack, Fislisbach; Violi Carmelo, Untersiggenthal, all of Switzerland

[73] Assignee: BBC Brown Boveri & Company Limited, Baden, Switzerland

[21] Appl. No.: 6,125

[22] Filed: Jan. 24, 1979

[30] Foreign Application Priority Data

Jan. 26, 1978 [CH] Switzerland ..... 839/78

[51] Int. Cl.[3] ..... H01H 33/00

[52] U.S. Cl. ..... 200/144 R; 137/614.04; 200/145; 200/148 R

[58] Field of Search ..... 200/144 R, 148 R, 145, 200/148 B; 137/614.04; 200/148 A, 148 C, 148 D, 148 E, 148 F, 148 G, 148 H, 148 J, 148 BV

[56] References Cited

U.S. PATENT DOCUMENTS

| | | | |
|---|---|---|---|
| 3,619,726 | 11/1971 | Boersma | 200/148 B |
| 4,106,523 | 8/1978 | Thornton et al. | 137/614.04 |

*Primary Examiner*—J. V. Truhe
*Assistant Examiner*—Morris Ginsburg
*Attorney, Agent, or Firm*—Burns, Doane, Swecker & Mathis

[57] ABSTRACT

An electrical gas blast circuit breaker is disclosed including first and second compartments for a pressurized quenching gas. The first and second compartments are connectible with the connection actuating valve members of each compartment. The actuation of the valve members automatically provides communication between the compartments upon connection of the compartments together. Transportation covers may be provided to releasably seal the ends of the compartments after manufacture and before connection of the compartments. The valve members are preferably spring biased with each valve member urged against the spring bias during connection of the compartments.

18 Claims, 6 Drawing Figures

ELECTRICAL GAS-BLAST CIRCUIT BREAKER AND METHOD OF MANUFACTURE

BACKGROUND AND SUMMARY OF THE PRESENT INVENTION

The present invention relates generally to an electrical gas-blast circuit breaker having several spaces which are filled with a quenching gas.

From the introduction to the description of German Auslegeschrift No. 1,102,858, it is known to subdivide electrical circuit breakers, which are filled with a gaseous quenching agent, into individual spaces. In this way, the quenching agent of each individual space may be maintained under a different pressure. In such an arrangement, the individual spaces can be connected to one another only via valves. Because of the different pressures prevailing in each of the individual spaces, a flow of the quenching agent, which is intended to quench the arc when breaking the circuit, is produced by opening the valves. Accordingly, the valves are open only upon switching of the circuit breaker.

Furthermore, in German Offenlegungsschrift No. 1,102,858, an electrical circuit breaker is described which is filled with a gaseous quenching agent. The agent may be sulphur hexafluoride and/or selenium hexafluoride with the circuit breaker sub-divided into several closed spaces (e.g. break chamber, actuating head and support insulator). The several closed spaces are connected to one another only by way of valves which close at a predetermined pressure difference between two spaces of the circuit breaker. During normal operation, all of the components of the circuit breaker or all of the spaces are accordingly connected to one another so that the quenching agent can circulate unhindered between the spaces. Furthermore, all of the gas contained in the circuit breaker is thus available for quenching the arc.

In the last-mentioned circuit breaker, the valves are accordingly constructed in such a way that the valves close immediately in the event of a predetermined pressure difference between two spaces. In this way, in the event that one part of the housing of the circuit breaker is leaking, the gas can only flow out of that part of the circuit breaker which is immediately affected.

In the known circuit breakers described above, the valves thus are arranged, when opened, to reduce an existing pressure difference of the quenching agent by way of a flow of quenching agent between the spaces filled with quenching gas or, if a pressure difference of the quenching agent arises between the spaces as a result of closing the valves, of preventing the generation of a flow of quenching agent by mutually isolating the spaces. In this way, it is completely impossible in view of the known prior art to achieve the objects of the present invention, using circuit breakers of the known type.

Accordingly, it is a principal object of the present invention to produce electrical gas-blast circuit breakers at a place of manufacture in various components so that one need only assemble the components together as transportation units in a very simple manner at the place of ultimate assembly. Such assembly may occur even under climatically unfavorable conditions. If necessary, only the pressure of the quenching gas in circuit breakers assembled according to the present invention needs to be varied in accordance with the operating conditions.

One of the advantages achieved by the present invention is that the circuit breaker can be manufactured in the form of a plurality of switch assemblies. The assemblies are filled with quenching gas at the place of production and are absolutely free from moisture and dust and are largely unaffected by the particular climatic conditions.

The quenching chambers together with the deflection chamber, that is to say the entire two-component circuit breaker unit, and the earth insulation or the insulator are at the same time constructed as automatically gas-tight transportable units in such a way that, upon assembly of the transportable units filled with quenching gas (or of the switch assemblies), the gas spaces of the unit are automatically connected in an advantageous manner to give a single gas space. Upon dismantling of the switch, the units can be taken apart again into switch assemblies which automatically become gas-tight.

Evacuation of circuit breakers mounted in the switching unit is thus unnecessary since the particular switch assemblies, and at the same time the transportable units, can be forwarded, already filled with the working gas from the place of production to the place of destination.

Furthermore, another advantage results since the circuit breaker can be assembled largely independently of the weather. Since it is no longer necessary to open the switch assemblies and the components (which merely have to be connected directly to one another), the assemblies can easily be kept free from moisture and dust. Accordingly, a great shortened assembly time results from the simplified assembly.

The present invention also results in considerable advantages with respect to maintenance of the circuit breaker and the replacement of components of the circuit breaker.

It was hitherto necessary to dismantle the circuit breakers and (in the event of the customarily relatively large constructional unit), to take the units, sub-divided into components, into a maintenance shed. As a result, the interior of the circuit breaker was already exposed, at least for the duration of transportation to the maintenance shed, to the ambient moist or dust-enriched atmosphere. Such an exposure had to be avoided under all circumstances, in particular in the case of $SF_6$ circuit breakers, because of the primary and secondary decomposition products and because of the subsequent reaction products of $H_2F_2$.

According to the present invention, the avoidance of exposure now becomes possible without difficulty in an advantageous manner since even large circuit breakers can be dismantled into the various switch assemblies. These gas-tight transportable units can then be transported into the maintenance shed without being adversely affected by the atmosphere.

Opening of a particular switch assembly, which may sometimes be necessary, can accordingly take place in the maintenance shed (which is under climatically controlled dust-free conditions). The cleaning of the interior of the assembly can therefore be carried out without the pressure of time, such as occurs in the case of circuit breakers which have to be opened outdoors, since an adverse influence of moisture on the interior of the circuit breaker cannot arise in the dry atmosphere of the maintenance shed.

A further advantage according to the present invention is that the successive cleaning of the circuit breaker in switch assemblies can be carried out by fewer people than is presently possible with circuit breakers that are opened outdoors.

Moreover, replacement in situ of quenching chambers or two-component circuit breaker units, which are correspondingly constructed according to the present invention to be automatically gas-tight, is possible in a very simple manner. It is not necessary, therefore, that the pole be evacuated and cleaned in a costly manner at the building site or in the switching unit.

It is particularly advantageous to construct the circuit breaker in order to achieve in a simple manner, in the case of circuit breaker components which can move relative to one another, a gas-tight closure in the region of the edge zone of the assemblies. Such a gas-tight closure is desirable at least in the transportation arrangement of the assembly by stationary gas-tight devices or seals.

A further advantage of the present invention includes the use of devices which can be switched over from a gas-tight to a gas-permeable condition and vice versa and which are located in fixed circuit breaker components in the region of the edge zone of the assemblies. In this way, a connection of the spaces, filled with quenching gas, of these assemblies is achieved automatically upon assembly of the switch assemblies, and a gas-tight closure is effected automatically in the region of the edge zones of the assemblies and ensured by the same devices and in an equally simple manner solely by taking the circuit breaker apart into its abovementioned switch assemblies.

According to a preferred embodiment of the present invention, the circuit breaker is constructed so that the switch assemblies, in combination with transportation covers, can both be transported and also be stored in a gas-tight condition for a prolonged period. Such an arrangement leads to the further advantage that the components of the circuit breaker, present in the switch assemblies, are fixed in the transportation position by the transportation covers.

It is also advantageous to construct the circuit breaker in order to connect the spaces within the switch assemblies and the associated transportation covers to one another in a simple manner and to enable the switch assemblies to be evacuated and pre-filled with quenching gas in a very simple manner via gas passage orifices in the transportation cover or in an insulator flange.

BRIEF DESCRIPTION OF THE DRAWINGS

A preferred embodiment of the present invention is described with reference to the appended drawings wherein like members bear like reference numerals and wherein.

DETAILED DESCRIPTION OF THE PRESENT INVENTION

Figures 1A, 1B:
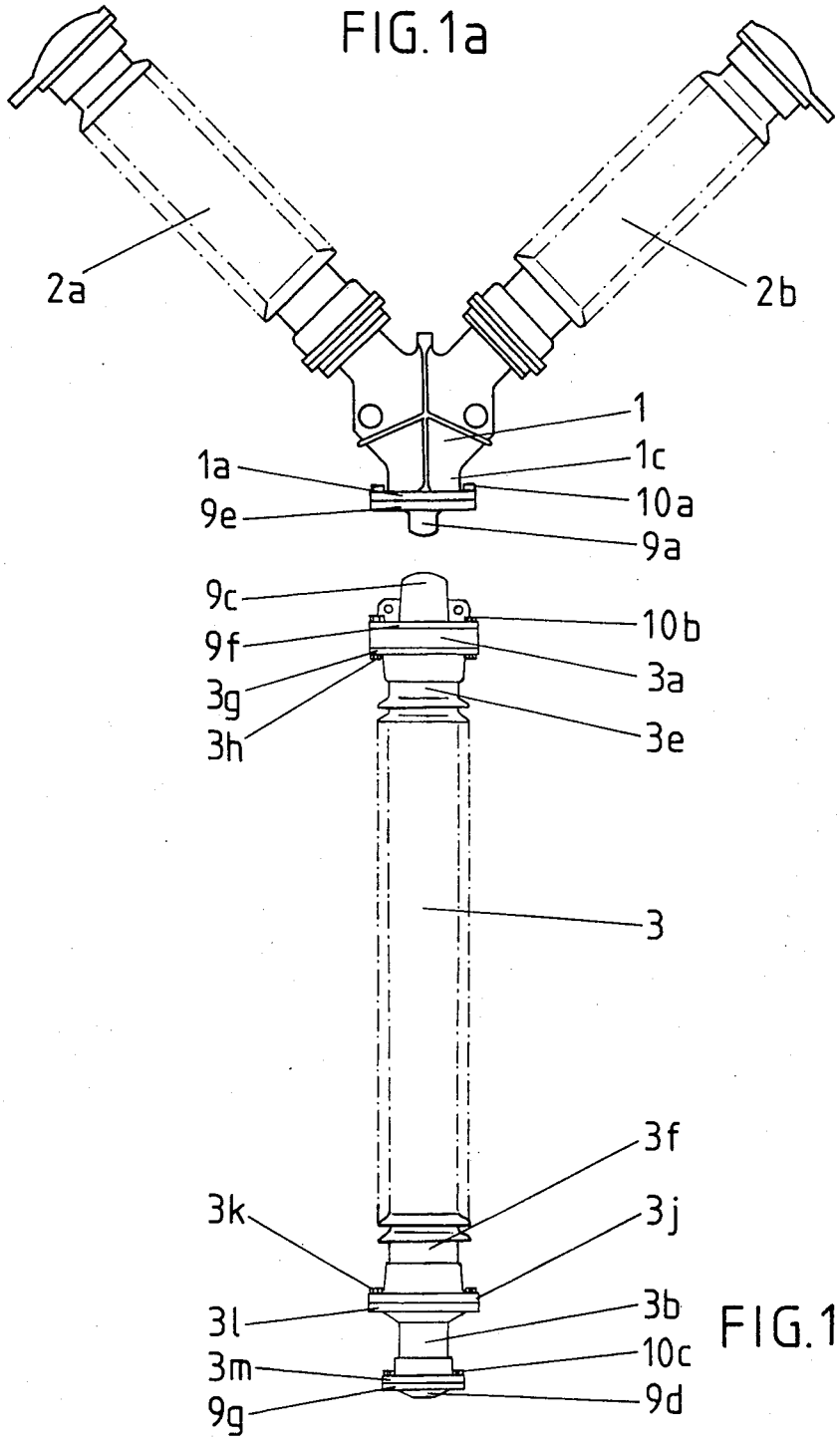
FIG. 1*a* is a side view of a deflection chamber of a switch assembly of an electrical gas-blast circuit breaker according to the present invention.
FIG. 1*b* is a side view of an insulator member of a switch assembly of an electrical gas-blast circuit breaker according to the present invention.

With reference to FIG. 1*a*, a deflection chamber 1 includes two quenching chambers 2*a* and 2*b* fixed thereto in a V configuration. An end 1*c* of the deflection chamber 1 is provided on an insulator side of the chamber and also a deflection chamber flange 1*a* is provided on the insulator side. On the insulator side of the deflection chamber flange 1*a*, the deflection chamber 1 is closed by a first transportation cover 9*a* with the deflection chamber flange 1*a* on the insulator side connected to a flange 9*e* of the first transportation cover 9*a* by a plurality of first bolts 10*a*.

In FIG. 1*b*, an insulator 3 has an end 3*e* on the deflection chamber side. The end 3*e* is connected by a connection flange 3*g* to an insulator flange 3*a* on the deflection chamber side by a plurality of connection bolts 3*h*. The insulator flange 3*a* is covered by a second transportation cover 9*c*, with a flange 9*f* of the cover 9*c* being bolted by a plurality of second bolts 10*b* to the insulator flange 3*a* on the deflection chamber side. An end 3*f* of the insulator 3 on the actuating side is connected by a fixing flange 3*j* (on the side of the fixing flange) to a flange 3*l* of the insulator flange 3*b* on the actuating side by a plurality of fixing bolts 3*k*. A flange 3*m* (on the transportation cover side) of the last-mentioned insulator flange 3*b* is closed by a third transportation cover 9*d* with a flange 9*g* thereof being connected by a plurality of third bolts 10*c* to the flange 3*m* on the transportation cover side.

Of course, the sub-division of the gas-blast circuit breaker can also be effected in a manner different from that illustrated in FIGS. 1*a* and 1*b*. Thus, for example, each of the quenching chambers 2*a* and 2*b* can form a switch assembly by themselves. In the case of relatively large circuit breakers, the insulator 3 can also be subdivided into several switch assemblies so that the transportation of the insulator is thereby facilitated at the same time. According to the present invention, the individual switch assemblies are gas-tight, and in particular gas-tight in a self-acting manner or automatically, and are transportable even without a transportation cover.

Figure 2A:
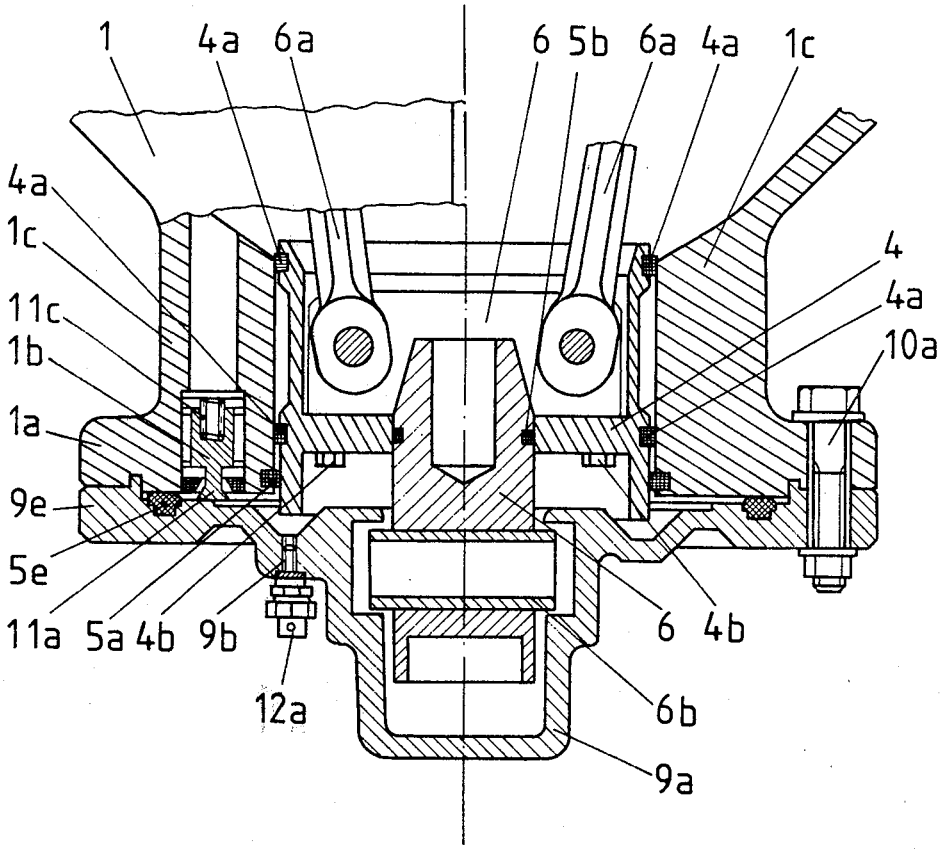
FIG. 2*a* is an enlarged cross sectional view of a portion of the deflection chamber together with the transportation cover.

With reference now to FIG. 2*a*, a first self-closing valve 1*b* is provided via which valve a space in the deflection chamber 1 is connected to a space between the first transportation cover 9*a* and the deflection chamber. A first end stop 11*a* of the valve 1*b* is lifted by a flange 9*e* of the first transportation cover 9*a*, (see FIG. 2*a*) in the axial direction into an open position. A first transportation seal 5*e*, located between the deflection chamber 1 and the first transportation cover 9*a*, ensures the gas-tightness of the switch assembly. The deflection chamber 1 is readily transportable with the cover 9*a* in place.

A piston 4 is guided in an axial direction by a guide ring 4*a* in the end 1*c* on the insulator side of the deflection chamber 1. The piston 4 is connected by a plurality of fixing bolts 4*b* to a forked member 6 which serves as a coupling. A second assembly seal 5*b* is located between the components 4 and 6. Deflection members 6*a* are illustrated in part and are fixed to the forked member 6. The forked member 6 is stabilized in the first transportation cover 9*a* by a coupling piece 6*b* formed of a tube so that a first assembly seal 5*a*, located between the piston 4 and the end 1*c* on the insulator side of the deflection chamber 1 acts at least during the duration of the stabilization.

The first transportation cover 9*a* has a first gas passage orifice 9*b* which can be closed by a first gas-tight bolt 12*a*. In this way, it is possible to manually evacuate the completely clean and dry deflection chamber 1 in a very simple manner and to pre-fill the chamber at the place of production with quenching gas, such as $SF_6$.

If the first transportation cover 9*a* is taken off of the deflection chamber 1 in the course of assembly or for any other reason, the first valve 1*b* closes because its first end stop 11*a* is urged downwardly under the action of the first valve spring 11*c*. The first assembly seal 5*a* and the second assembly seal 5*b*, at least temporarily (until the deflection chamber 1 is assembled), effect a gas-tight closure of the remaining region of the deflection chamber flange 1*a* on the insulator side.

Figure 2B:
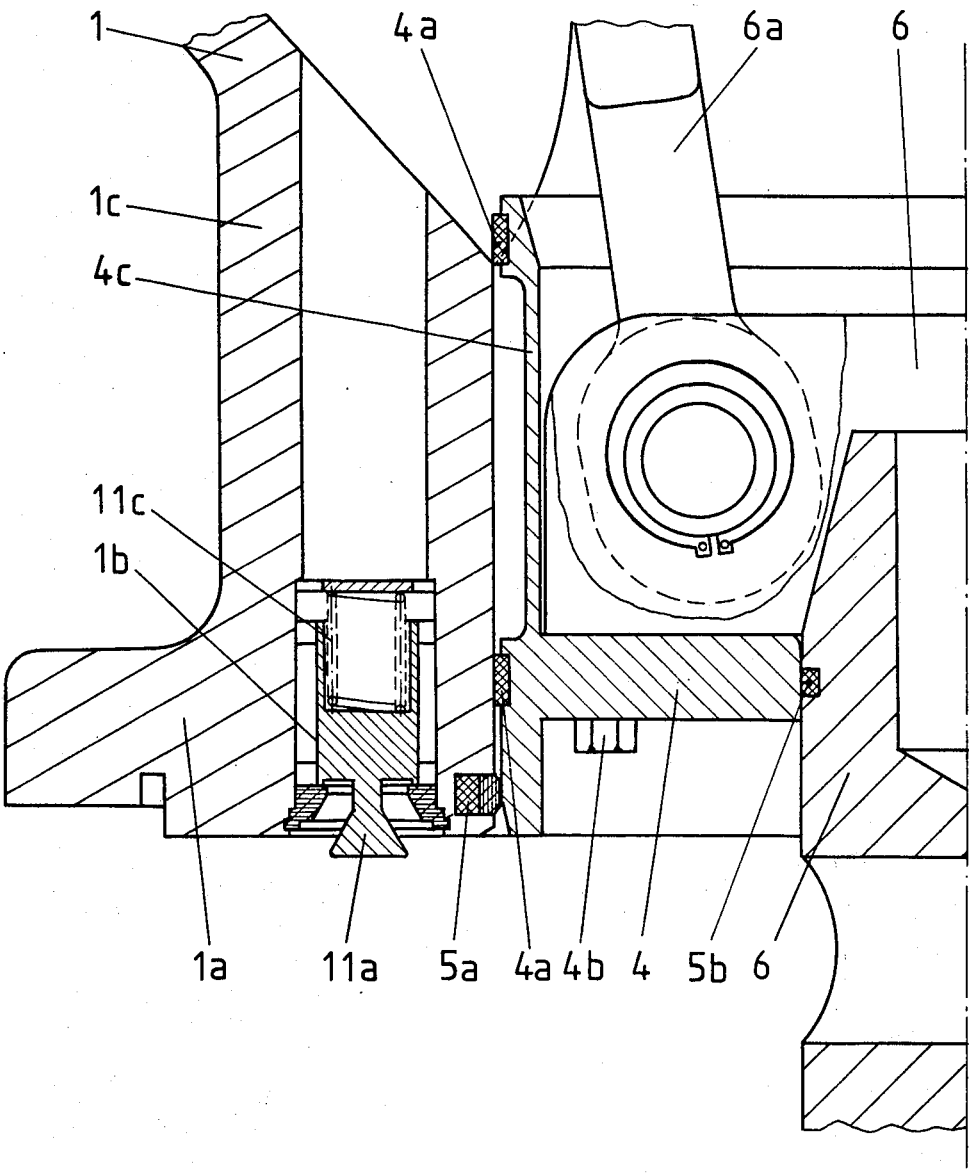
FIG. 2*b* is an enlarged cross sectional view of a portion of the deflection chamber of FIG. 1*a* with the transportation cover removed.

With reference now to FIG. 2*b*, the first self-closing valve 1*b* is in the closed state due to the absence of the first transportation cover 9*a*. Compared with the position of the piston 4 in FIG. 2*a*, the same piston 4 is lifted in FIG. 2*b* in the axial direction in such a way that a guide ring 4*a* at a free end of a guide barrel 4*c* of the piston 4 just runs off of the guide of the end 1*c* of the deflection chamber 1 on the insulator side. The contact surface of the piston 4 for the first assembly seal 5*a* has, in such a position of the piston, a change from its cylindrical form into a conical form.

As shown in FIG. 2*b*, the first assembly seal 5*a* consists of both an outer and an inner ring of different material. An elastic outer ring is correspondingly compressed by the inner ring under the action of the piston 4 with the inner ring thus bearing in a gas-tight manner against the piston 4. As soon as the piston 4 runs off of the inner ring, the sealing action of the inner ring no longer occurs, whereas the sealing action of the second assembly seal 5*b* is steady and independent of the particular position of the piston 4.

Figure 3:
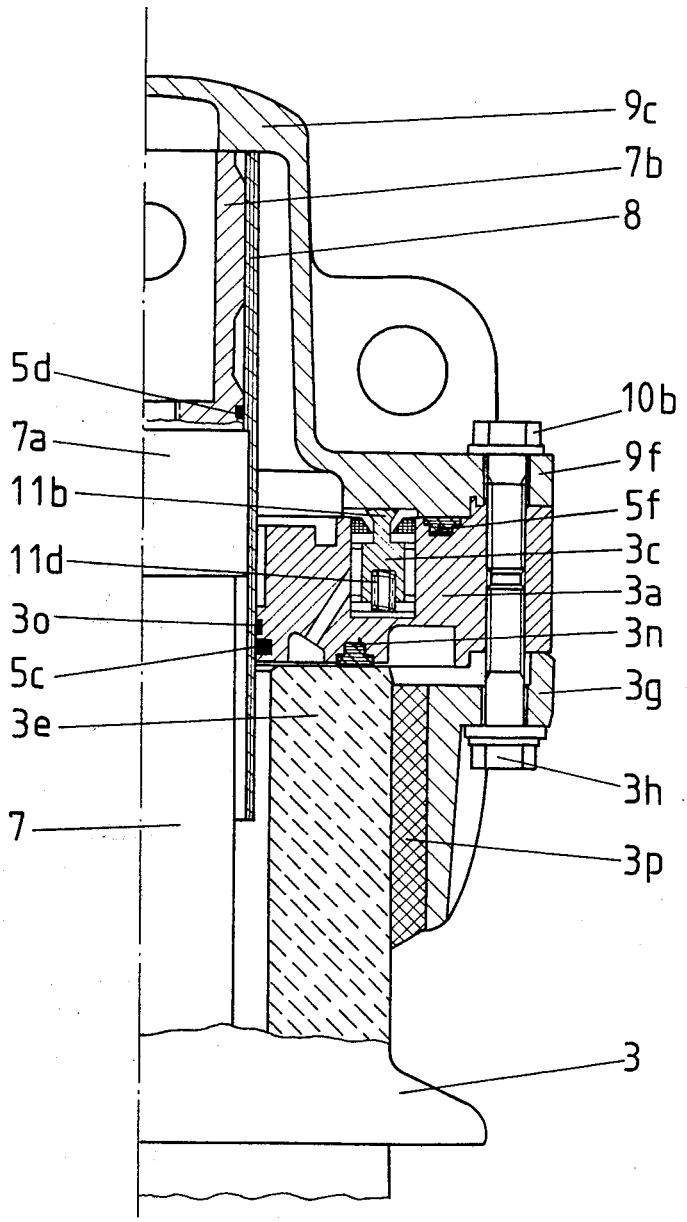
FIG. 3 is a cross sectional view of an end of the insulator member of FIG. 1*b* together with the transportation cover.

With reference to right-hand half of FIG. 3, an actuating bar 7 has, on an end 7*a* on the deflection chamber side, a coupling part 7*b*. A free end of the part 7*b* is fixed by a second transportation cover 9*c*. Furthermore, a stepped plastic tube 8 which surrounds both the coupling part 7*b* and the end 7*a* on the deflection chamber side, is stabilized in the illustrated position by the transportation cover 9*c* and the end 7*a*.

A steadily acting fourth assembly seal 5*d* is located between the plastic tube 8 and the coupling part 7*b*. A second end stop 11*b* of the second self-closing valve 3*c* is pressed downwardly by an inside of the flange 9*f* into an open position so that the spaces, filled with quenching gas, of the insulator 3 and of the second transportation cover 9*c* are connected to one another. Between the second transportation cover 9*c* and the insulator flange 3*a* on the deflection chamber side, a second transportation seal 5*f* is located. The seal 5*f* remains as an assembly seal between the deflection chamber 1 and the insulator 3 when the deflection chamber 1 is assembled with the insulator 3 in the course of assembling the circuit breaker. Correspondingly, a further assembly seal 3*n* is provided between the insulator flange 3*a* on the deflection chamber side and the end 3*e* of the insulator 3 on the deflection chamber side.

At the same time, a third assembly seal 5*c* and a further guide ring 3*o* are located between the plastic tube 8 and the insulator flange 3*a* on the deflection chamber side. A connection flange 3*g* is fixed by a connecting device 3*p* to an end 3*e* of the insulator 3 on the deflection chamber side. As soon as the second transportation cover 9*c* is taken off, (in the course of assembly of the circuit breaker), by undoing the plurality of second bolts 10, the second valve 3*c* closes. The valve 3*c* closes since its second end stop 11*b* is biased under the action of the second valve spring 11*d*. The third assembly seal 5*c*, the fourth assembly seal 5*d* and the further assembly seal 3*n*, at least until the insulator 3 constructed as a switch assembly is mounted, together effect a gas-tight closure of the remaining insulator in the region of the insulator flange 3*a* on the deflection chamber side.

Figure 4:
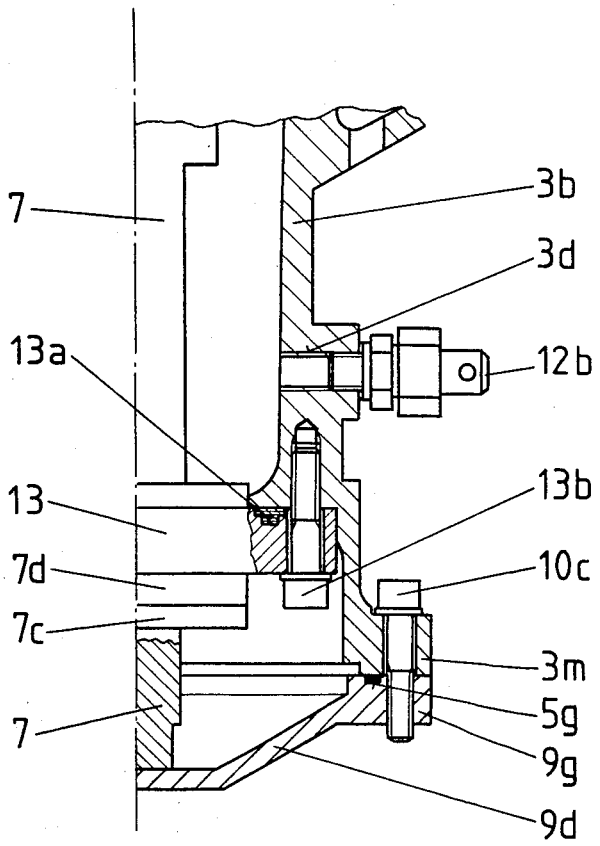
FIG. 4 is a cross sectional view of another end of the insulator member of FIG. 1*b* together with the associated transportation cover.

With reference now to FIG. 4, the insulator flange 3*b* on the actuating side is closed gas-tight by a third transportation cover 9*d* with the simultaneous interposition of a third transportation seal 5*g*. The actuating bar 7 is, furthermore, clamped in between the second transportation cover 9*c* and the third transportation cover 9*d* in such a way that a bar-sealing flange 7*c* is in close contact with a sealing flange 7*d* of a closing flange 13 of the insulator flange 3*b* on the actuating side. A plurality of seals (which are not illustrated in FIG. 4) are described in German Patent Application P 2,737,726.0, and come to act both between the bar-sealing flange 7*c* and the sealing flange 7*d* and between the sealing flange 7*d* and the closing flange 13. A closing assembly seal 13*a* is also provided between the closing flange 13 and the insulator flange 3*b* on the actuating side.

The closing flange 13 is here fixed by a plurality of additional fixing bolts 13*b* to the insulator flange 3*b* on the actuating side. The insulator flange 3*b* on the actuating side has a second gas-tight bolt 12*b* so that the insulator 3 which is constructed as a switch assembly or as a transportation unit, can be conveniently evacuated and pre-filled with quenching gas.

As can be seen from FIGS. 2*a* and 4, temporarily stationary gas-tight devices, such as the first assembly seal 5*a*, stationary gas-tight devices such as the second assembly seal 5*b*, and devices which can be switched over from gas-tight to gas-permeable and vice versa, such as the first self-closing valve 1*b* or the second self-closing valve 3*c*, are accordingly provided in the regions of adjacent edge zones of the assemblies. These regions include for example the region of the deflection chamber flange 1*a* on the insulator side as well as the insulator flange 3*a* on the deflection chamber side and the insulator flange 3*b* on the actuating side. The individual switch assemblies can be closed gas-tight for shorter or longer periods as desired by the devices in such a way that the gas-tightness in the region of adjacent edge zones 1*a*, 3*a*, 3*b* of the assemblies is at least partially removed automatically and the spaces, filled with quenching gas, of the circuit breaker are thus automatically connected to one another.

As can be seen from the figures, the temporarily steady gas-tight effectiveness of, for example, the first assembly seal 5*a* depends upon the mutual position of the end 1*c* on the insulator side of the deflection chamber 1 relative to the position of the piston 4. Accordingly, the components 1*c* and 4 must be mutually stabilised in order to be able to ensure the gas-tightness by reason of the first assembly seal 5*a*. The steady gas-tight effectiveness of the second assembly seal 5*b*, on the other hand is independent of the particular position of the adjacent components, such as the position of the piston 4 and of the forked member 6.

Finally, the open or closed position of the devices which can be switched over, such as the first or second self-closing valves 1*b*, 3*c*, depend on whether the switching assemblies are present separately, (that is to say without the first, second and third transportation cover 9*a*, 9*c*, 9*d*), or whether they are assembled to provide a circuit breaker. The last-mentioned valves 1*b*, 3*c* can hereby be located in the switch assemblies in mutually opposite positions in particular in such a way that the first end stop 11*a* and the second end stop 11*b* switch each other into the open position of the valves after assembly of the circuit breaker.

The use of devices which have a temporarily steady gas-tight action, such as, for example, the first assembly seal 5*a*, both make gas-tightness of the particular switch assembly possible in a simple manner and improve the ability of the individual spaces (filled with quenching gas), of the circuit breaker to communicate (in cooperation with, for example, the first self-closing valve 1*b*).

By using transportation covers for the individual switch assemblies, the gas-tightness of the assemblies can be ensured even for a long period, for example for the period of an intermediate storage. Furthermore, as a result of the mutual stabilization of the components of the circuit breaker, which can be combined therewith, the use of devices of simple construction, which have a temporarily steady gas-tight action, is possible for sealing switch assemblies. Such sealing is possible at least for the time of the stabilization, and the sealing action thereof is at least temporarily removed by assembling and putting the circuit breaker into operation. In this way, further connection between the spaces filled with quenching gas can be produced in a very simple manner similar to the devices 1*b*, 3*c* which can be switched over and which are switched into their open position after assembly of the circuit breaker by the insulator flange 3*a* on the deflection chamber side or the deflection chamber flange 1*a* on the insulator side respectively.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. An assembly for an electrical gas blast circuit breaker, comprising:

a first compartment housing a first switch assembly, said first compartment being filled with a pressurized quenching gas;

a second compartment housing a second switch assembly, said second compartment being filled with the pressurized gas;

connection means for selectively joining the first compartment to the second compartment;

first stationary sealing means for at least temporarily sealing the first compartment;

second stationary sealing means for at least temporarily sealing the second compartment;

third sealing means for selectively sealing the first compartment; and fourth sealing means for selectively sealing the second compartment, said third and fourth sealing means communicating the first compartment with the second compartment when the first and second compartments are connected, the third and fourth sealing means automatically sealing the first compartment and the second compartment when the first and second compartments are separated.

2. The assembly of claim 1 wherein the third sealing means includes a first valve member for the first compartment and wherein the fourth sealing means includes a second valve member for the second compartment, the first and second valve members being actuated when the first and second compartments are joined to one another.

3. The assembly of claim 2 wherein the first and second valve members are spring biased in a closed position.

4. The assembly of claim 3 further comprising:

first and second transportation covers, each cover selectively sealingly engaging one of the first and second compartments.

5. The assembly of claim 4 wherein the first and second transportation covers actuate the valve members when the transportation covers sealingly engage the first and second compartments.

6. The assembly of claim 2 wherein the first compartment includes a deflection chamber having first and second chambers for the pressurized quenching gas and wherein the second compartment includes an insulative member.

7. The assembly of claim 6 wherein the deflection chamber includes a first flange and wherein the second compartment includes a second flange, the first and second flanges mating with one another when the first and second compartments are joined to one another.

8. The assembly of claim 4 further comprising fifth sealing means for sealing each of the transportation covers to the one of the first and second compartments.

9. The assembly of claim 7, wherein the first flange actuates the second valve member and the second flange actuates the first valve member when the first and second compartments are joined to one another.

10. The assembly claim 2 wherein the first and second valve members are arranged adjacent one another when the first and second compartments are joined together so that the first and second valve members actuate each other.

11. The assembly of claim 4 wherein the first and second transportation covers are each joined to one of the first and second compartments by bolts.

12. The assembly of claim 4 wherein the first valve member has a first end stop, the first end stop bearing against an inside of the first transportation cover when the first transportation cover sealingly engages the first compartment to thereby actuate the first valve member and communicate the first compartment with an interior of the first transportation cover.

13. The assembly of claim 12 wherein the second valve member has a second end stop, the second end stop bearing against an inside of the second transportation cover when the second transportation cover sealingly engages the second compartment to thereby actuate the second valve member and communicate the second compartment with an interior of the second transportation cover.

14. The assembly of claim 1 further comprising:

manually actuated valve means for each of the first and second compartments whereby the pressurized quenching gas may be selectively supplied and withdrawn from each of the compartments.

15. A method of assembling a housing assembly for an electrical gas blast circuit breaker, comprising the steps of:

filling a first compartment housing a first switch assembly with a pressurized quenching gas;

filling a second compartment housing a second switch assembly with the pressurized quenching gas;

releasably sealing each of the compartments;

joining the first and second compartments together; and automatically communicating the first and second compartments when the first and second compartments are joined together.

16. The method of claim 15 further comprising the steps of:

sealing each of the compartments with a removable transportation cover after filling but before the joining of the compartments together; and, removing the transportation cover immediately prior to joining the compartments together.

17. The method of claim 16 further comprising the step of:

transporting the first and second compartments from a place of filling with the pressurized quenching gas to a place of the joining after the transportation covers seal each of the compartments.

18. The method of claim 16 further comprising the step of:

manually actuating a manual valve to adjust the pressure of the pressurized gas in the first and second compartments after joining the compartments together.

* * * * *